United States Patent [19]

Langman

[11] 4,417,690

[45] Nov. 29, 1983

[54] STEEL RAILROAD SLEEPER

[75] Inventor: William F. Langman, Lonsdale, Australia

[73] Assignee: Omark Industries, Inc., Portland, Oreg.

[21] Appl. No.: 205,014

[22] Filed: Nov. 7, 1980

[30] Foreign Application Priority Data

Nov. 27, 1979 [AU] Australia ..... PE1496

[51] Int. Cl.[3] ..... E01B 3/16

[52] U.S. Cl. ..... 238/59; 238/264

[58] Field of Search ..... 238/70, 80, 81, 59, 238/60, 61

[56] References Cited

U.S. PATENT DOCUMENTS

| | | | |
|---|---|---|---|
| 782,398 | 2/1905 | Howard | 238/59 |
| 1,936,824 | 11/1933 | Buchholz | 238/61 |
| 2,502,281 | 3/1950 | Sann | 238/59 |

*Primary Examiner*—Richard A. Bertsch

*Attorney, Agent, or Firm*—Duffield & Lehrer

[57] ABSTRACT

A steel railway sleeper has side walls and an upper wall, the upper wall having two pairs of upwardly formed protuberances, the protuberances of each pair forming respective rail retaining recesses which will hold rails correct to gauge, provide an upstand to which the stud is to be welded thereby reducing stud length, and provide a platform on which the spring clip can be positioned when the rails are assembled to the sleeper.

8 Claims, 5 Drawing Figures

STEEL RAILROAD SLEEPER

BACKGROUND OF INVENTION

This invention relates to a railroad sleeper formed from steel which is useful for maintaining the gauge of rails.

Various configurations have been proposed in the past for retaining rail gauge in a railroad, including the formation of depressions in the upper surface of a sleeper, the location of apertures in a sleeper, and other configurations. It has also been proposed to maintain gauge by a stud welding process.

This invention seeks to provide a rugged steel sleeper which is capable of maintaining gauge, and which can be used in conjunction with a simple spring type retaining clip (for example in accordance with our U.S. patent application Ser. No. 366,655 filed Apr. 8, 1982), and which can also be utilised with insulation pads.

If a railroad sleeper is provided with depressions in its upper surface, those depressions must be formed against the rigidity of the upstanding walls and this requires tremendous forces and therefore large presses. Furthermore, reduction of section modulus results in loss of strength. Alternatively, if use is made of apertures in a sleeper, the apertures constitute weakness zones having high stress concentration points, and these are regarded with considerable disfavour. These problems have been largely solved by a previous invention of ours making use of a stud welding process, but the stud welding process requires jigging to achieve accuracy of positioning. The cross sectional shape and size of a weld stud is extremely limited. Therefore the surface area available for the rail foot to abut is minimal providing little resistance to sleeper "skewing" and also limited resistance to wear.

Another object of this invention is to provide a very simple sleeper which by it configuration will retain gauge and yet which will not be excessively expensive to produce.

When a railroad sleeper is loaded by a vehicle passing over rails supported by the sleeper, the metal stresses at the localities of the rails include a vector addition of longitudinal stresses along the sleeper and transverse stresses across the sleeper, and in some instances these stresses are subject to reversal. These stresses are greatest at the top of the sleeper and are critical at the rail localities. However, it is adjacent the rails that the studs are welded, and it is inherent in a welding process of any fastening system to a steel rail that residual stresses remain in the rail adjacent the weld metal, and this can in some instances result in fatigue cracking. The danger of fatigue cracking is increased in those localities wherein the residual welding stresses are additive to the live load stresses.

Another object of the invention is to provide a sleeper which by its configuration increases the section modulus at the localities where fastening systems are welded, thereby proportionately reducing live load stresses.

If a sleeper has a constant cross-sectional shape throughout its length, there is a relationship between the bending moment and the distance along the sleeper from the rail, the maximum bending moment being at the locality of the rail. It is a further object of this invention to provide a sleeper which by its shape moves the critical area of the sleeper logitudinally along the sleeper to a locality of reduced bending moment for some at least of the anticipated applied loads.

BRIEF DESCRIPTION OF THE INVENTION

In this invention a sleeper is formed of steel and having side walls and an upper wall, characterised by two pairs of upwardly formed platforms in the upper wall, the platforms of each pair defining between them a respective rail retaining recess.

There are many advantages in utilising such an arrangement. For example, the walls defining the platform ends can be used as datum surfaces for locating a rail to gauge, thereby avoiding the need to jig gauge retaining means and avoiding the need to form apertures in the sleeper. The platforms can be formed with a relatively light press, not requiring such heavy pressures as are required if depressions are formed by pressing the upper surface downwardly against the side walls. The platforms cause the surface of the sleeper adjacent to a rail to be a little higher on each side of the rail so that any stud welded lug for retaining a clip is relatively short in length and is therefore subject to relatively small bending moments. This is of considerable importance when a rail foot is associated with an insulating pad, and insulating pads are regarded as being essential in many instances in the use of steel sleepers.

The platforms can be varied in height thus permitting different weights of rail, having consequential different foot thicknesses to be accommodated by identical spring clips and studs with or without resilient or insulating pads. The upper surface of each platform may be flat providing a surface on which the spring clip can be positioned prior to assembly.

BRIEF DESCRIPTION OF THE DRAWINGS

An embodiment of the invention is described hereunder in some detail with reference to, and as illustrated in, the accompanying drawings, in which.

DETAILED DESCRIPTION OF INVENTION

Figure 1:
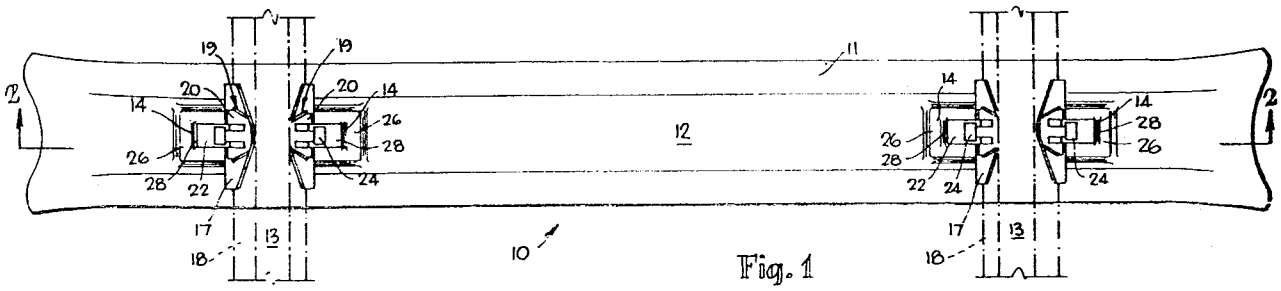
FIG. 1 is a plan view of a sleeper, showing the manner in which a pair of rails are located for gauge and secured.

In the accompanying drawings, a rail sleeper 10 is provided with side walls 11, and an upper wall 12. The upper wall 12 is deformed upwardly at each side of the rail 13, the upwardly deformed portions being designated as platforms 14. The side walls of each platform 14 slope gently to the side walls 11 of the sleeper, the facing end walls 15 and 16 are vertical or nearly vertical for short distances, the inner end walls 15 and 16 abutting the outer side edges of a resilient insulating pad 17, which partly wraps around the foot 18 of the rail 13. The pad 17 is formed to be longer than the width of the upper wall 12, providing an overlap which "breaks" capillary paths. The pad 17 is provided with a pair of recesses 19 each of which contains a respective bearing plate 20, and a resilient U-shaped fastening clip 22 bears downwardly on the plate 20. The clip 22 is in accordance with our U.S. patent application Ser. No. 366,655, filed Apr. 8, 1982.

There is also provided a pair of studs 24 which are stud welded to respective the platforms 14, each stud 24 having a head 25 which bears downwardly on a recessed upper portion of its respective clip 22.

For removal of the clips 22, it is desirable to insert a tool into the aperture defined by the bridge portion of the U-shape, and the stud 24, and the upper wall 12 then provides an abutment surface against which the removing tool can abut, so that the tool can be levered outwardly to withdraw the respective clips 22. The clips 22 can of course be simply "knocked on" in a direction transverse to the longitudinal direction of rail 13.

Each platform 14 has a flat portion 27 to which a respective stud 24 is welded. The outer end wall 26 of each platform slopes downwardly to merge the upper wall 12 of the sleeper 10, but is associated with a projection 28 in the upper wall of the platform, the projection 28 standing a little above the platform upper wall, and slightly outboard of the heel of the respective fastening clip. This increases the difficulty of removal of the fastening clip without a special purpose tool, thus providing a "vandal-proof" feature.

As said above, the invention provides means whereby the bending moments imparted against the studs 24 is reduced because of the shorter stud lengths than would be used if there were no platforms. The rail gauge is maintained with a great deal of accuracy, and with a relatively inexpensive shoulder configuration. Insulation is easily effected. The sleeper is not weakened nor are any stress concentration points established by use of this invention, and at the localities of the platforms, the section modulus is actually increased. The slepper is entirely imperforate, having no apertures of any kind therein, and this feature reduces production costs, avoids development of stress concentpoints, and reduces incidence of rust which otherwise develops at the localities of perforations.

The platforms 14 have important effects in reducing the weld fatigue hazards of the sleeper metal adjacent the studs 24:

Firstly, the section modulus of the sleeper is increased at the platform localities and therefore, the live load stresses are proportionately reduced;

Secondly, the stiffening effect of the side walls of the platform places the critical bending areas of the sleeper further away from the rails into localities of lower bending moments for certain of the applied loads;

Thirdly, although the platform side walls are somewhat thinned in the deformation of the sleeper, there is very little thinning of the platforms 27 to which the studs are welded.

The welds are therefore in relatively low stress areas of the sleeper, which have, however, nearly the same metal thicknesses as the impressed areas of the sleeper, and the fatigue crack hazard is much less than if the welds were in a sleeper without the platforms.

Figure 2:
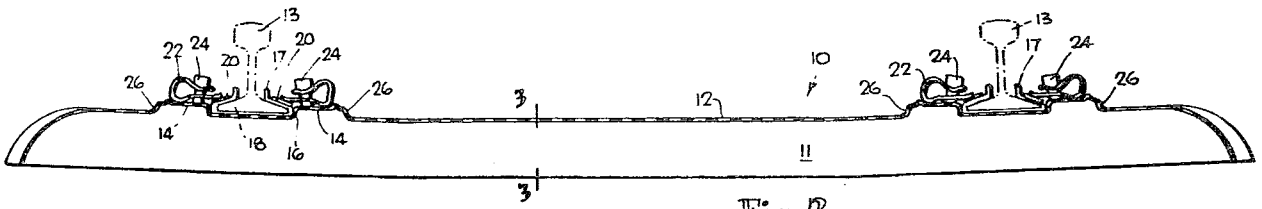
FIG. 2 is an elevational section on line 2—2 of FIG. 1.
Figure 5:
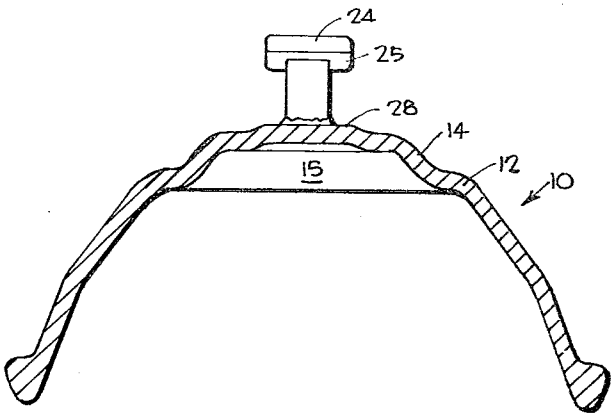
FIG. 5 is a fragmentary section taken on line 5—5 of FIG. 4.
Figure 3:
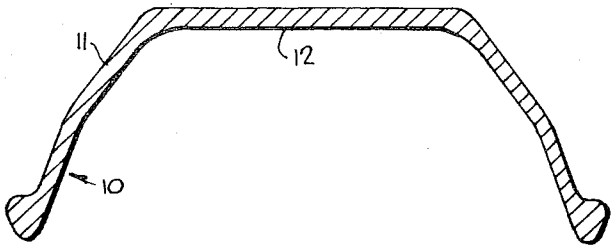
FIG. 3 is a cross-section taken on line 3—3 of FIG. 2.
Figure 4:
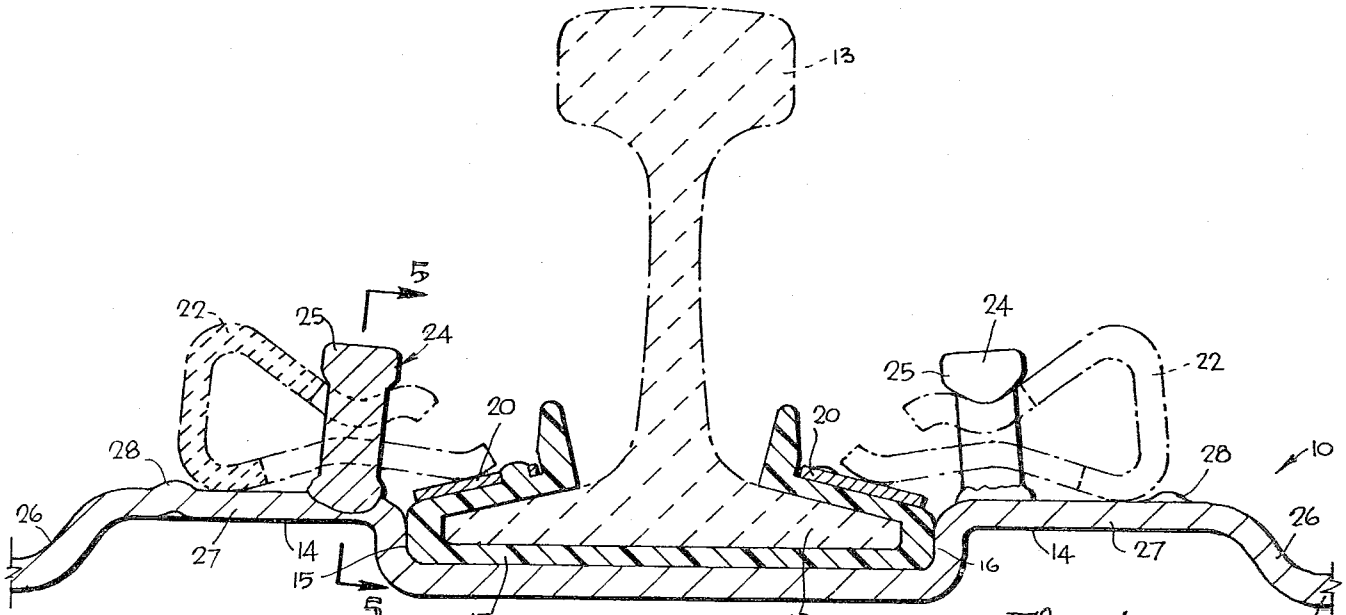
FIG. 4 is a fragmentary longitudinal section, corresponding in part to FIG. 3, but illustrating clearly the manner in which one of said rails is located with respect to the sleeper and secured thereto.

Another important feature of the rail sleeper of the present invention is the manner in which the inclination of the rails is achieved. This may be seen from FIG. 2 of the drawings. The entire steel sleeper is deformed along its entire length in a slightly upward bowed manner to provide the required inclination of the rail retaining recess which, in turn, imparts the necessary inclination to the rail 13. In accordance with the rail sleeper of the present invention, this inclination can be obtained with relatively light pressing and deformation of the entire sleeper in contradistinction to forging operations to achieve the inclination in the area of the rail recess only in relatively thick walled sleepers as heretofore known.

What is claimed is:

1. A sleeper formed of steel and having side walls and an upper wall which are entirely imperforate, two pairs of raised platforms in the upper wall each formed by upward deformation of an upper portion of said sleeper, the platforms of each pair defining between them a respective rail retaining recess, a plurality of studs each stud welded to and upstanding from a respective said platform, and each stud having a head of such shape that each stud is T-shaped.

2. A sleeper formed of steel and having side walls and an upper wall, and two pairs of upwardly formed platforms in the upper wall, each said platform having an inner end wall which is approximately vertical and the two vertical inner end walls of each said pair of platforms defining the side edges of a respective rail retaining recess, and each said platform having a flat portion, and a headed stud projecting upwardly from that flat portion, the stud having been secured thereto by a stud welding process.

3. A sleeper according to claim 2 wherein each said platform has an outer end wall which slopes down to the upper wall of said sleeper.

4. A sleeper according to claim 3 wherein each said platform has a projection which projects upwardly from said flat portion and merges into said downwardly sloping outer end wall.

5. A sleeper according to claim 2 wherein each said platform is formed by upward deformation of a portion of the upper wall of said sleeper.

6. A sleeper according to claim 2 wherein each of said walls is entirely imperforate.

7. A sleeper formed of relatively light gauge steel and having side walls and an upper wall, and two pairs of upwardly formed platforms in the upper wall, each separate platform having an end wall which is approximately vertical and the two vertical end walls of each said pair of platforms defining the side edges of a respective rail retaining recess, and the sleeper being deformed along at least a portion of the rail sleeper to provide inclination inwardly to each of the respective rail retaining recesses to provide rail inclination.

8. A sleeper pressed from rolled steel stock of initially uniform cross-section and having side walls and an upper wall and two pairs of raised platforms each formed by upward deformation of a portion of the upper wall, each platform having a flat portion adapted for receipt of a rail securing means and a first end wall which is approximately vertical, two side walls and a second end wall for each platform, the vertical first end walls of each pair of platforms defining the side edges of a respective rail retaining recess and all walls of each platform increasing the section modulus of the rail sleeper in the cross-section of the platform.

* * * * *